166-274 SR
11/17/87 XR 4,706,750

United States Patent [19]
Buckles

[11] Patent Number: 4,706,750
[45] Date of Patent: Nov. 17, 1987

[54] METHOD OF IMPROVING $CO_2$ FOAM ENHANCED OIL RECOVERY PROCESS

[75] Inventor: John J. Buckles, Dallas, Tex.

[73] Assignee: Mobil Oil Corporation, New York, N.Y.

[21] Appl. No.: 23,073

[22] Filed: Mar. 6, 1987

[51] Int. Cl.[4] ..... E21B 43/24; E21B 43/26; E21B 43/263

[52] U.S. Cl. ..... 166/271; 166/272; 166/274; 166/299

[58] Field of Search ..... 166/271–274, 166/299, 308, 309

[56] References Cited

U.S. PATENT DOCUMENTS

| | | | |
|---|---|---|---|
| 3,335,794 | 8/1967 | Bond | 166/273 |
| 3,342,261 | 9/1967 | Bond | 166/309 X |
| 3,464,491 | 9/1969 | Froning | 166/273 X |
| 3,893,511 | 7/1975 | Root | 166/309 X |
| 4,039,030 | 8/1977 | Godfrey et al. | 166/299 |
| 4,091,870 | 5/1978 | Godfrey et al. | 166/299 |
| 4,265,310 | 5/1981 | Britton et al. | 166/271 X |
| 4,516,636 | 5/1985 | Doscher | 166/271 X |
| 4,548,252 | 10/1985 | Stowe et al. | 166/299 |
| 4,590,997 | 5/1986 | Stowe | 166/308 X |
| 4,610,304 | 9/1986 | Doscher | 166/272 X |

*Primary Examiner*—George A. Suchfield
*Attorney, Agent, or Firm*—Alexander J. McKillop; Michael G. Gilman; Lawrence O. Miller

[57] ABSTRACT

Oil is recovered from a subterranean oil-containing formation by fracturing the formation around the injection well and thereafter injecting a $CO_2$ foam or a mixture of steam and a $CO_2$ foam into the injection well to displace mobilized oil toward a production well for recovery.

19 Claims, No Drawings

METHOD OF IMPROVING $CO_2$ FOAM ENHANCED OIL RECOVERY PROCESS

BACKGROUND OF THE INVENTION

Field of the Invention

The present invention pertains to a $CO_2$ foam drive process for recovering oil from a subterranean oil-containing formation. More particularly, the present invention involves an improved $CO_2$ foam drive and recovery method from a subterranean formation penetrated by at least one injection well and at least one spaced-apart production well wherein the formation around the injection well is fractured before the $CO_2$ foam is injected into the formation for oil recovery.

A variety of supplemental recovery techniques have been employed in order to increase the recovery of oil from subterranean formations. These techniques include thermal recovery methods, waterflooding and miscible flooding.

Fluid drive displacement of oil from an oil-containing formation utilizing $CO_2$ is known to have the following effect in enhancing the recovery of viscous oils: (1) oil swelling, (2) viscosity reduction; and (3) when dissolved in an aqueous driving fluid it dissolves part of the formation rock to increase permeability. As the oil viscosity increases, a straightforward $CO_2$ immiscible flood becomes less effective because of gravity override and viscous fingering due to unfavorable mobility ratio as disclosed in the article by T. M. Dosher et al, "High Pressure Model Study of Oil Recovery by Carbon Dioxide", SPE Paper 9787, California Regional Meeting, Mar. 25–27, 1981. It is known that the oil displacing efficiency of a $CO_2$ drive can be improved by mixing the $CO_2$ with a foaming agent to produce a $CO_2$ foam oil recovery driving fluid. The foam is effective at controlling $CO_2$ channeling due to stratification and fingering. In addition, the foam also effectively reduces the mobility of $CO_2$ in porous media and controls $CO_2$ injection profiles, resulting in increased oil recovery and sweep improvements. Numerous patents have been issued on the recovery of oil using a $CO_2$ foam drive which include U.S. Pat. Nos. 3,330,346; 4,113,011; and 4,380,266. In addition, U.S. Pat. No. 4,577,688 discloses the use of steam, $CO_2$ and a foaming agent in an oil recovery process.

The present invention more effectively utilizes the $CO_2$ foam in a $CO_2$ foam enhanced oil recovery process by first fracturing the oil-containing formation around the injection well so that the subsequent injection of $CO_2$ foam can more effectively penetrate the formation resulting in enhanced oil recovery and a reduction in the amount of $CO_2$ required.

SUMMARY OF THE INVENTION

This invention relates to the recovery of oil from a subterranean oil-containing formation penetrated by at least one injection well and at least one spaced-apart production well comprising: (a) forming a plurality of horizontal fractures extending radially around said injection well; (b) injecting into said injection well a mixture of $CO_2$ and a foaming agent; and (c) recovering fluids including oil from the formation by the production well. In addition, the mixture of $CO_2$ and a foaming agent may also contain steam. In another embodiment of the method of my invention, after fracturing, a slug of foaming agent in an aqueous solution is injected into the injection well ahead of the $CO_2$.

DESCRIPTION OF THE PREFERRED EMBODIMENTS

The present invention is carried out in a subterranean oil-containing formation penetrated by spaced injection and recovery systems extending from the surface of the earth into the formation. The injection system consists of one or more wells into which is introduced a suitable $CO_2$ foam and/or steam. The recovery system comprises one or more wells from which product is recovered. The wells in the injection and recovery systems are spaced apart and can be arranged in any desired pattern such as patterns well known in waterflood operations. For example, the pattern can comprise a central injection well and a plurality of production wells spaced radially around the injection well or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure which is hereby incorporated by reference.

In practicing the invention, a plurality of horizontal fractures are formed radially around the injection wells. The fractures are preferably formed in the high permeability portion of the formation. Any method known in the art can be used to form the fractures. The most feasible method, however, is to form these fractures by control pulse fracturing which typically produces a radial pattern of about 6 to 8 fractures which are about 10 feet high by 10 feet long by ½ inch wide. Control pulse fracturing consists of fracturing the formation with high-energy gas as described in the Final Report entitled "High Energy Gas Fracturing Development", by J. F. Cuderman, Sandia National Laboratories, Box 5800 Albuqueque, N.M. 87185, prepared for the Gas Research Institute, Contract No. 5080-321-0434, the disclosure of which is incorporated herein by reference.

The fractures may also be formed by hydraulic fracturing as used in well stimulation. Hydraulic fracturing techniques have been widely used for stimulating wells penetrating subterranean hydrocarbon-bearing formations by creating fractures which extend from thw wells into the formation. These techniques normally involve injecting a fracturing fluid down a well and into contact with the subterranean formation to be fractured. A sufficiently high pressure is applied to the fracturing fluid to initiate a fracture in the formation and the fracturing fluid is injected down the well at a sufficiently high rate to propagate the fracture thereinto. Propping materials are normally entrained in the fracturing fluid and are deposited in the fracture to maintain the fracture open.

After fracturing, a mixture of $CO_2$ and a foaming agent is injected into the fractures of the formation via the injection well at an injection rate of 0.3 to 3.0 barrels of mixture per day per acre-foot of formation. The $CO_2$ foam driving fluid mobilizes the oil and displaces the mobilized oil through the formation toward the production well from which fluids, including oil, are recovered. During this step of the process, the foaming agent concentration based upon the weight of the $CO_2$ is about .01 to about 2.0% by weight in the injected mixture. Injection of the mixture of $CO_2$ and a foaming agent is continued until there is $CO_2$ breakthrough at the production well. The advantage of the fractures around the injection well is to enable the mixture of $CO_2$ and foaming agent to extend further from the injection well thus making more $CO_2$ available to sufficiently reduce the viscosity of the oil for maximum recovery. In addition, the fractures around the injection well result in less injectivity loss of the mixture of $CO_2$ and foaming agent. When injected with $CO_2$, the foaming agents are effective in reducing the permeability of the high permeability zones in the formation since the foaming agent has an affinity for formation areas of high permeability and low oil saturation. Thus, when injected with $CO_2$, the foaming agent substantially reduces the permeability of the high permeability zones thus forcing the $CO_2$ into other areas of the formation resulting in increased oil recovery and sweep improvements.

In another embodiment of the invention, steam may be injected along with a mixture of $CO_2$ and foaming agent. This mixture consists of steam, about 0.2 to about 5 reservoir barrels of $CO_2$ per reservoir barrel of steam in the injected mixture and about 0.1% to about 2.0% by weight of a foaming agent based upon the weight of the steam (cold water equivalent) in the injected mixture. The quality of the steam is from about 20% to about 90%, preferably 70%.

In another embodiment of method of my invention, a slug, preferably 1 to 10% pore volume, of foaming agent in an aqueous solution is injected ahead of $CO_2$. The aqueous solution preferably contains 0.1 to 2.0% by weight foaming agent. $CO_2$ foam will then be formed in situ when the $CO_2$ reaches and mixes with the foaming agent within the formation. Since the foaming agent will normally undergo chromatographic transport delay during its injection in aqueous form, the fractures would enable foaming agent to reach further into the formation more quickly by avoiding this chromatographic delay process near the wellbore for a distance approximately equal to the length of the fractures.

Suitable foaming agents which may be employed in the present invention include cationic, nonionic, amphoteric, and particularly anionic surfactants from the classes such as alcohol ethoxysulfates, alcohol ethoxysulfonates, alpha-olefin sulfonates, toluene sulfonates, alkyl sulfonates, disulfonated alkyl diphenyloxides, and glycerol sulfonates. These foaming agents include such trademark chemicals as Alipal CD-128, Enordet A0S-12, Foamer NES-1412, Enordet X-2001, and Stepanflo-50. The most preferred foaming agent is Alipal CD-128.

Although the present invention has been described with preferred embodiments, it is to be understood that modifications and variations may be resorted to without departing from the spirit and scope of this invention as those skilled in the art will readily understand. Such variations and modifications are considered to be within the purview and scope of the appended claims.

What is claimed is:

1. A method for recovering oil from a subterranean oil-containing formation penetrated by at least one injection well and at least one spaced-apart production well comprising (a) forming a plurality of horizontal fractures extending radially around and near said injection well;

(b) injecting into said injection well a mixture of $CO_2$ and a foaming agent; and (c) recovering fluids including oil from the formation via the production well.

2. A method according to claim 1 wherein the horizontal fractures are formed by control pulse fracturing.

3. A method according to claim 1 wherein the horizontal fractures are formed by hydraulic fracturing.

4. A method according to claim 1 wherein said foaming agent is selected from the group consisting of anionic sulfates and anionic sulfonates.

5. A method according to claim 1 wherein said fractures extend radially around the injection well for a horizontal distance of about 10 feet and a vertical distance of about 10 feet in the high permeability portion of the formation.

6. A method according to claim 1 wherein step (b) is continued until there is $CO_2$ breakthrough at the production well.

7. A method for recovering oil from a subterranean oil-containing formation penetrated by at least one injection well and at least one spaced-apart production well comprising (a) forming a plurality of horizontal fractures extending radially around and near said injection well;

(b) injecting into the injection well a mixture of steam, about 0.2 to about 5 reservoir barrels of $CO_2$ per reservoir barrel of steam in the injected mixture and about 0.1% to about 2.0% by weight of a foaming agent based upon the weight of the steam in the injected mixture; and (b) recovering hydrocarbons and other fluids from the formation via the production well.

8. A method according to claim 7 wherein the horizontal fractures are formed by control pulse fracturing.

9. A method according to claim 7 wherein the horizontal fracture are formed by hydraulic fracturing.

10. A method according to claim 7 wherein said foaming agent is selected from the group consisting of anionic sulfonates, alpha-olefin sulfonates and toluene sulfonates.

11. A method according to claim 7 wherein said fractures extend radially around the injection well for a horizontal distance of about 10 feet and a vertical distance of about 10 feet in the high permeability portion of the formation.

12. A method according to claim 7 wherein step (b) is continued until there is $CO_2$ breakthrough at the production well.

13. A method for recovering oil from a subterranean oil-containing formation penetrated by at least one injection well and at least spaced apart production well comprising:

(a) forming a plurality of horizontal fractures extending radially around and near said injection well, (b) injecting into said injection well a slug of a foaming agent in an aqueous solution;

(c) injecting $CO_2$ into said injection well; and (d) recovering fluids including oil from the formation via the production well.

14. A method according to claim 13 wherein the horizontal fractures are formed by control pulse fracturing.

15. A method according to claim 13 wherein the horizontal fractures are formed by hydraulic fracturing.

16. A method according to claim 13 wherein said fractures extend regularly around the injection well for a horizontal distance of about 10 feet and a vertical distance of about 10 feet in the high permeability portion of the formation.

17. The method of claim 13 wherein step (c) is continued until there is a $CO_2$ breakthrough at the production well.

18. A method according to claim 13 wherein said foaming agent is selected from the group consisting of anionic sulfates and anionic sulfonates.

19. A method according to claim 13 wherein the aqueous solution contains 0.1% to 2.0% by weight of foaming agent.

* * * * *